US005110127A

United States Patent [19]

Potter

[11] Patent Number: 5,110,127

[45] Date of Patent: May 5, 1992

[54] MULTIPLE GAMING BOARDS

[75] Inventor: James Potter, 314 E. El Rio Grande, Garland, Tex. 75041

[73] Assignee: James Potter, Garland, Tex.

[21] Appl. No.: 643,856

[22] Filed: Jan. 22, 1991

[51] Int. Cl.[5] ..... A63F 7/06

[52] U.S. Cl. ..... 273/85 R; 273/94; 273/128 R; 273/284; 273/88

[58] Field of Search ..... 273/85 R, 94, 88-90, 273/353, 317, 284, 128 R

[56] References Cited

U.S. PATENT DOCUMENTS

| | | | |
|---|---|---|---|
| 808,111 | 12/1905 | Pell | 273/94 R |
| 1,603,717 | 10/1926 | Rubino et al. | 273/94 R |
| 1,712,073 | 5/1929 | Fowler | 273/85 R |
| 1,980,274 | 11/1934 | Insall et al. | 273/94 R |
| 2,152,882 | 4/1939 | Engel | 273/94 R |
| 2,261,448 | 11/1941 | Peterson | 273/85 R |
| 2,362,188 | 11/1944 | Clark | 273/89 |
| 2,680,618 | 6/1954 | Williams | 273/88 |
| 4,257,599 | 3/1981 | Cutri | 273/85 R |
| 4,513,974 | 4/1985 | Lin | 273/239 |
| 4,555,114 | 11/1985 | Dozier | 273/128 R |
| 4,872,679 | 10/1989 | Bohaski et al. | 273/85 R |

FOREIGN PATENT DOCUMENTS

| | | | |
|---|---|---|---|
| 325134 | 10/1957 | Switzerland | 273/85 R |

*Primary Examiner*—Edward M. Coven
*Assistant Examiner*—Sebastiano Passaniti
*Attorney, Agent, or Firm*—Ross, Howison, Clapp & Korn

[57] ABSTRACT

A gaming board system includes a plurality of gaming boards indicating various sports. Each of the gaming boards utilizes a plurality of playing pieces and goals. The playing piece is a triangular shaped device that can either be held vertically and propelled by striking the lower end thereof or laid flat on the surface of the gaming board and propelled by striking one side thereof to urge it in a forward direction. Goals are provided at either end of the gaming boards and disposed in an upright position to allow the player to propel the playing piece vertically upward and over the goal. Alternatively, the playing piece can be disposed flat on the gaming board to allow the gaming piece to be propelled along the surface of the board into the goal. Inclined side surfaces are also provided to maintain the playing piece in the playing area.

4 Claims, 4 Drawing Sheets

MULTIPLE GAMING BOARDS

TECHNICAL FIELD OF THE INVENTION

The present invention pertains in general to games and, more particularly, to a collection of gaming boards having a playing piece that can be propelled through a goal above the surface of the playing board.

BACKGROUND OF THE INVENTION

Gaming boards have generally been well known in the art. Most gaming boards utilize some type of flat surface and playing pieces. Typically, there are a set of rules utilized in conjunction with the playing surface to manipulate the gaming pieces thereon. Some gaming boards are considered to be passive, with a set of cards or the such. Those utilizing the gaming pieces can be considered interactive; that is, the players move the gaming pieces in response to throwing dice or rotating a pointer. Still yet further interactive gaming boards utilize a playing piece that can be propelled through the air in a third dimension above the surface of the board. These have been well known as "finger football" games, which have been played by children for a number of years. However, to date, no successful gaming board has been developed utilizing the third dimension above the surface of the board.

SUMMARY OF THE INVENTION

The present invention disclosed and claimed herein comprises a gaming board system. The gaming board system includes a plurality of gaming boards and a box for containing the gaming boards. A plurality of playing tokens are provided that include at least one game piece. The game piece is a triangular member having three sides with one side being longer than the other two remaining sides. The playing piece is operable to be supported on one corner in an upright position with the one longer side facing a player. The player can then impart a force to the lower end thereto relative to the supported corner to propel the playing piece forward and off the supporting surface. At least one of the gaming boards includes a flat surface, a playing pattern disposed on the flat surface with goal lines disposed at opposite ends of the pattern. The goals include uprights disposed above the surface of the playing area and disposed apart a pre-determined distance. A horizontal bar is disposed between the lower ends thereof and above the playing surface. A collapsible net is disposed on either end of the playing surface and is operable to be pulled upward behind the goals when the playing piece is propelled thereat. Inclined sides are provided along the flat surface at an angle such that they extend upward from the playing surface to contain the playing piece in the playing area.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
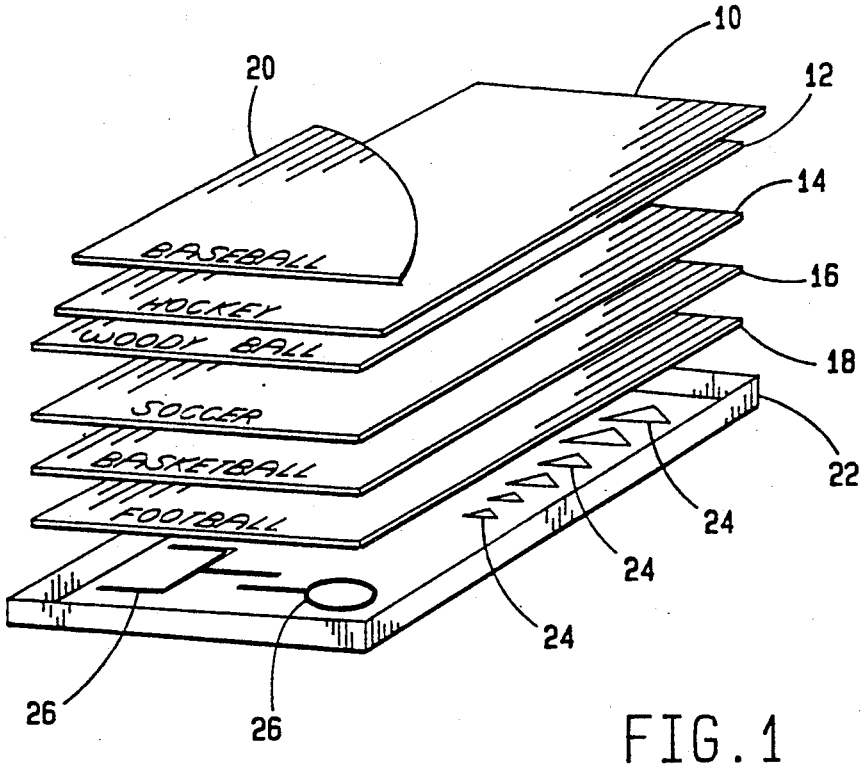
FIG. 1 illustrates an exploded view of the collection of gaming boards.

Referring now to FIG. 1, there is illustrated an exploded view of the gaming board system of the present invention, illustrating six different gaming boards 10–20. The gaming board 10 is utilized for hockey, the gaming board 12 is utilized for a generic game termed "woodyball", the gaming board 14 is utilized for soccer, the gaming board 16 is utilized for basketball and the gaming board 18 is utilized for football. All of the gaming boards 18–20 are dimensioned such that they fit into a box 22 or container for storing the gaming boards. In addition, the container 22 contains the playing pieces 24 and also goals 26. These are typically disposed in a storage area in the box 22.

Figure 2A:
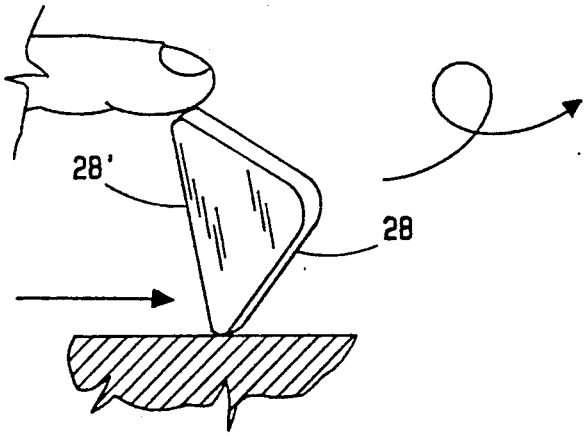
FIGS. 2*a* and 2*b* illustrate the way in which the major playing piece is propelled during the game.
Figure 2B:
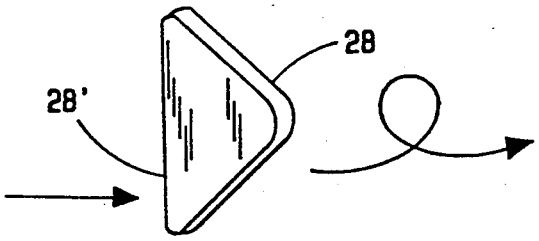

Referring now to FIGS. 2*a* and 2*b*, there are illustrated methods by which the main playing piece, the "ball" is utilized during playing of the game. In FIG. 2*a*, the ball is represented by a triangular playing piece 28. The playing piece 28 has three faces and is rounded on all corners, with one face 28' being the impacting face. The playing piece 28 is disposed on one corner thereof with the finger holding the other corner thereof such that the face 28' is disposed substantially perpendicular to the playing surface and facing the player. The player then impacts the lower end of the face 28' or "thumps it" with his finger. This causes the lower corner thereof along the face 28' to rotate outwards and upwards. This provides the third dimensional aspect above the surface of the playing surface on boards 18–20. This will be described in more detail hereinbelow.

Referring now to FIG. 2*b*, there is illustrated an alternate way of utilizing the playing piece 28. In this operation, the playing piece 28 is laid on its side on the surface of the playing board. The face 28' is disposed substantially parallel to the playing surface and then the player "thumps" the face 28' on one end thereof to cause the playing piece 28 to spiral outward therefrom across the surface of the playing board but not leaving the surface of the playing board. This also will be described in more detail hereinbelow.

Figure 3A:
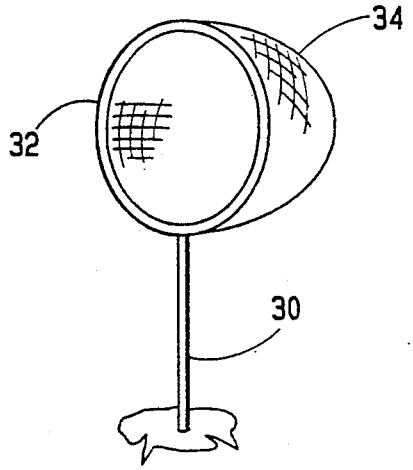
FIGS. 3*a*, 3*b* and 3*c* illustrate the various goals.
Figure 3B:
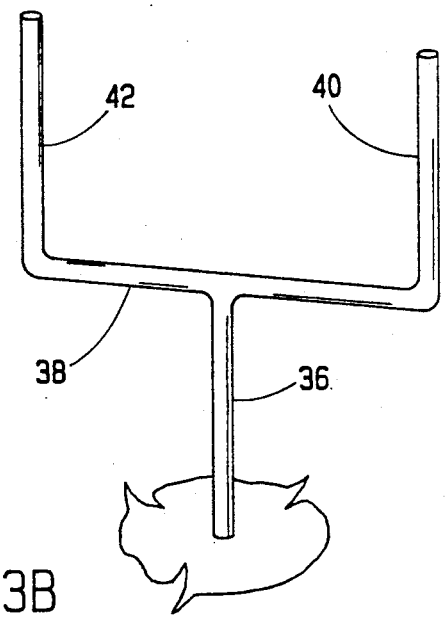
Figure 3C:
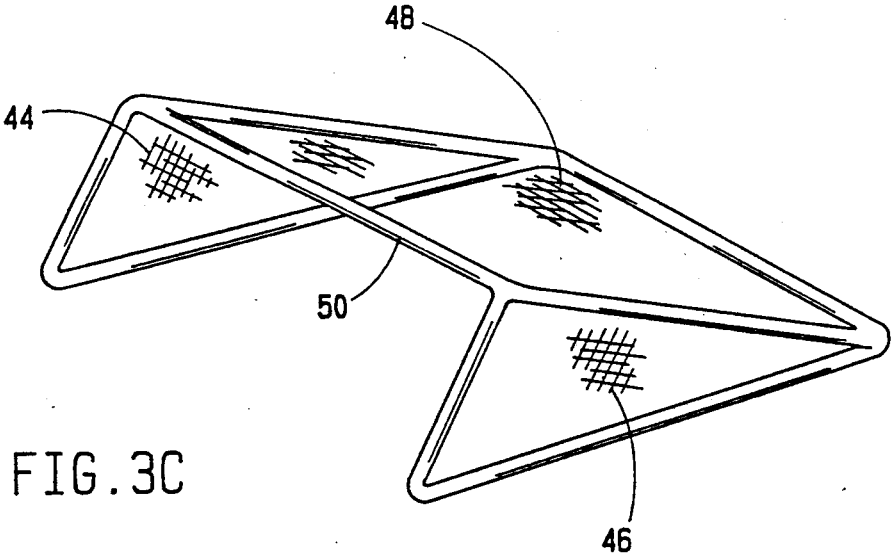

Referring now to FIGS. 3*a*–3*c*, there are illustrated various types of goals that are utilized for the playing of the game of the present invention. In FIG. 3*a*, a goal is illustrated for use in playing the basketball game on playing board 16. An upright 30 is provided for being disposed substantially perpendicular to the playing surface. A hoop 32 is disposed on the upper end of the upright 30, which hoop is substantially circumferential in shape and is disposed perpendicular to the playing surface. A net 34 is disposed around the peripheral edges of the hoop 32 and extends outward therefrom. The net 34 is typically made from a relatively rigid material such that it does not collapse of its own weight.

Referring now to FIG. 3*b*, there is illustrated the goal utilized for the generic "woodyball" game board 12 and also football game board 18. The goal is comprised of an upright 36 that is disposed perpendicular to the playing surface, and a horizontal bar 38 that is disposed on the distal end of the upright 36 and centered thereon. On either end of the horizontal bar 38 are disposed uprights 40 and 42, extending upward from the most distal ends of the horizontal bar 38 and substantially parallel to the upright 36. As will be described hereinbelow, it is the object of the game to propel the playing piece 28 from a place on the playing surface through the two uprights 40 and 42 and above the horizontal bar 38.

Referring now to FIG. 3*c*, there is illustrated a perspective view of the goal utilized for the soccer game board 14 and the hockey game board 10. The goal is generally comprised of two side portions 44 and 46 that support a rear portion 48. The rear portion 48 has a horizontal bar 50 that is disposed above and parallel to the playing surface. The rear portion 48 extends downward from the horizontal bar 50 to the playing surface at an angle thereto. The side portions 44 and 46 support the rear portion 48 to provide an opening in one side thereof. The opening allows the playing piece 28 to be propelled therein on the surface of the playing board.

Figure 4:
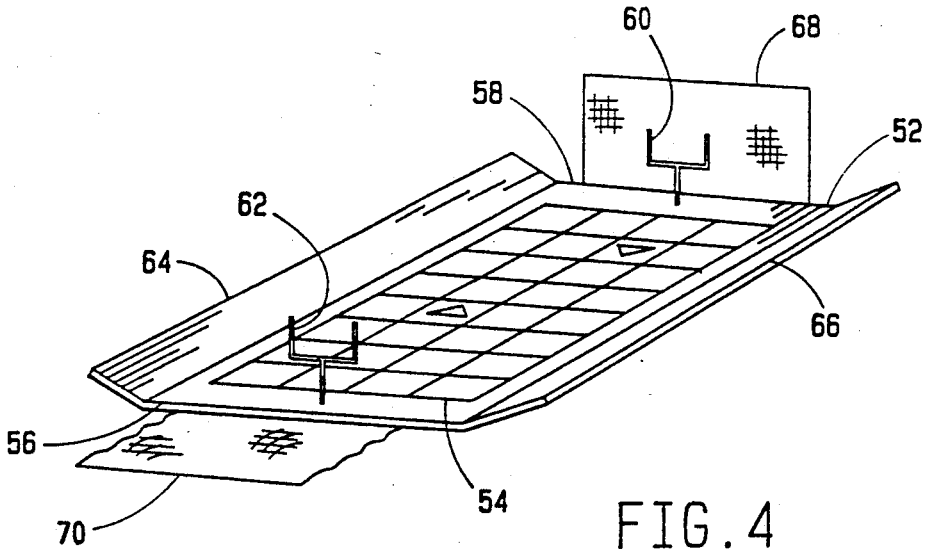
FIG. 4 illustrates a perspective view of the gaming board utilized for football and a generic game.

Referring now to FIG. 4, there is illustrated a perspective view of the playing surface for the gaming boards 12 and 18, utilized for the generic "woodyball" game and the football game. The gaming board is generally comprised of a flat surface 52 upon which a pattern 54 is disposed. There are two ends 56 and 58 to the rectangular shaped flat surface 52. The goals, comprised of the goals in FIG. 3*b*, are disposed on either side of the printed pattern 54 and anchored thereto. These are referred to by reference numerals 60 and 62 at ends 58 and 56, respectively. Along each side of the flat surface 52 are disposed deflector panels 64 and 66. The deflector panels 64 and 66 run along the sides of the flat surface 52 between ends 58 and 56 and angle upward. These are utilized to prevent the playing pieces from falling off of the board, or in general containing them within the playing surface. In addition, a collapsible net 68 is disposed on the end 58 and a collapsible net 70 is disposed on the end 56. The collapsible nets 68 and 70 are operable to be pulled to a substantially perpendicular orientation with respect to the playing surface 52 by the player. This is done when the opposite player is attempting to propel the game piece 24 through the goal at the other player's end. In the diagram of FIG. 4, the net 68 is pulled upward in a perpendicular configuration such that the playing piece can be propelled through the uprights on the goal 60. Net 68 allows some method for preventing the playing piece 28 from being propelled off of the playing surface 52. When not utilized, the net 68 can be collapsed such that the other player can have access to the gaming board. The net 70 is illustrated in this collapsed position.

The gaming board in FIG. 4 is utilized to play the generic "woodyball" game and the football game. In the "woodyball" game, the object of the game is to be the first to collect twenty "woody points" by either a "touchdown goal" or a "woody goal". A "touchdown goal" receives two woody points and a "woody goal" receives one woody point. A touchdown is obtained by propelling the playing piece 28 across the surface of the playing board and causing it to stop on the edge of the printed pattern 54. This will provide a score of two points. A goal is obtained by propelling the playing piece 28 through the uprights of either one of the goals 60 or 62 at the opponent's end of the playing surface. This provides a score of one point. After a touchdown has been made, an extra point attempt is provided for.

To begin play in the generic "woodyball" game, the player to start first is determined by a coin toss. The first player would then place the playing piece 28 on the pattern 54 at a predetermined point along the playing surface. These are typically divided up into segments of ten increments, each increment representing yards on the playing surface. Therefore, there will be graduations marked for the ten yard, twenty yard, etc., to a middle point of fifty yards from each end of the pattern 54. Initially, the playing piece 28 is disposed on the twenty yard line nearest to the player. The playing piece 28 is then propelled along the surface of the gaming board. If the playing piece 28 stops short of the end of the printed pattern 54, referred to as the goal line, then the player has the option of attempting to again propel the playing piece 28 along the surface to touch the goal line or attempt to propel the playing piece vertically through the uprights of the goal. This then results in alternation of players with each player attempting to be the first to obtain a total of twenty points. After a successful "touchdown" wherein the playing piece has been disposed on the goal line, the player can gain another point by propelling the playing piece 28 through the uprights from the thirty yard line nearest the goal.

In the football gaming board 18, the pattern 54 has a plurality of game tokens shaped similar to the playing piece 28 but smaller. The graduations in the playing surface 54 are divided up into a plurality of boxes, with each box having various worded statements or the such denoted therein. These worded statements correspond to various penalties and plays in the game of football, which is conventional. For example, one box on the twenty yard line has the statement, "Complete pass, advance one space", which indicates that when the playing piece is disposed on that space, that the token can be advanced by one space. Each space therefore provides some indication of a play or a penalty in the game of football.

The object of the game is to move the game token from start to finish, collecting points. Points are collected when players land on a space marked for "woody goal", and in completing a field goal with their playing piece 28 from a designated yard line on the playing field. The player begins the game on his side of the lower left hand corner at a start block. The player then rolls a pair of dice (not shown) and moves the number of spaces shown on the dice, moving up one column and down the next adjacent column and will continue until he has traversed all columns to the end. The worded spaces provide the actions which the player can take until he has finally stopped on a space. The next player then takes his turn. This continues until four lengths of the field have been completed for a total of "four quarters". During traversing of the worded spaces, certain spaces will indicate that an individual can propel the playing piece 28 through the goal from that point. This will collect a point if the playing piece 28 successfully passes between the uprights on the goal.

Figure 5:
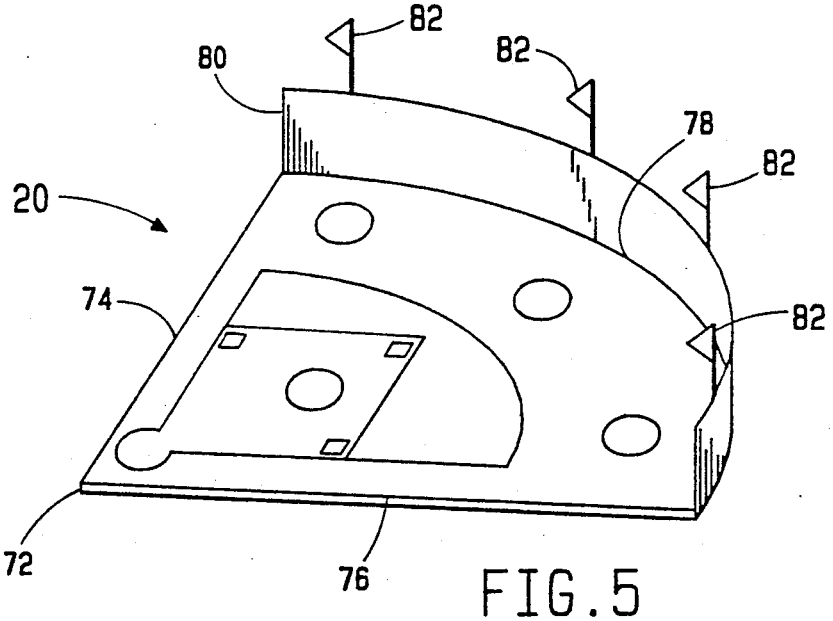
FIG. 5 illustrates the gaming board utilized for baseball.

Referring now to FIG. 5, there is illustrated a perspective view of the playing surface for the baseball gaming board 20. The baseball gaming board 20 is generally shaped like a baseball diamond and it is triangular shaped having an apex 72 that extends outward on two sides 74 and 76 with the ends of the sides 74 and 76 being connected with an arc 78. The arc 78 represents the outfield of the gaming board. A wall 80 is provided along the arc 78 and extends up from the surface of the playing board 20. Four flags 82 are disposed on the wall 80 to define uprights and provide three "regions" corresponding to "right" field, "left" field and "center" field. A pattern is disposed on the surface of the playing board 20 illustrative of the baseball playing field. The object of the game is to advance as many tokens around the playing field from first base to home base before utilizing a player's supply of special tokens defined as "out tokens". The playing field has a number of worded circles at first base, second base, third base, right field, left field and center field. These worded circles indicate the types of actions that are to be taken. Each of the worded circles has worded actions disposed therein.

Initially, each player receives a playing piece 28, nine "out tokens" and ten playing tokens. The dice are rolled to determine which player starts and then the first player places a playing token on the home base portion of the playing field. The dice are then rolled to determine where the play will start, i.e., which of the worded circles that the play will start in. For example, the dice may indicate that play is to start in right field. At the right field circle, the dice are again rolled to determine the play itself. For example, if a value of "1" were rolled with the dice, this would indicate a "fly out" action. The first number therefor represents a playing area or worded circle, each worded circle having a number, and the second number rolled with the dice represents the play denoted in that circle. The token at home base is then placed at the appropriate base.

If a player lands on a home run, he is then instructed by the wording in the appropriate circle at which fence, right field, left field or center field, to propel the playing piece 28. These are indicated by the flags 82, which comprise the uprights. The playing piece 28 is then disposed at the home plate, proximate to the apex 72 and then "thumped" or propelled toward the wall 80 between the appropriate flags 82. If complete, the playing tokens are then advanced around the bases toward home plate. Scoring is as in a conventional baseball game. A playing token can only be forced from its space by an advancing token. For example, if a player has a token on third base and a two base hit was rolled, the player will move the token from home base to second base, but the token at third base stays until forced to move by another two-base or three-base hit or by a home run. When a player lands at an out space, he must remove all playing tokens from the bases and give up one out token. This will end the inning for that player. He then records the number of runs scored onto a score pad. The next player will take his turn in the same manner. If when rolling the dice, a double number is rolled, a circle at the pitcher's mound indicates a number of plays. For example, whenever two "2"s are rolled, this indicates that a hit to left field has been made, and the playing token advances two bases. The play continues until all players have utilized their out tokens.

Figure 6:
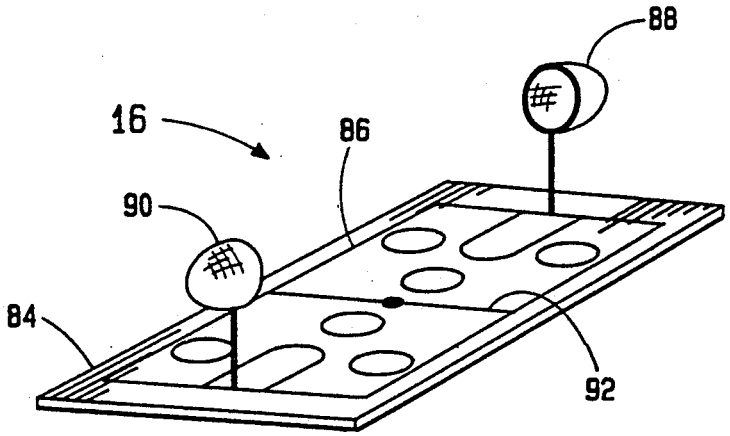
FIG. 6 illustrates the gaming board utilized for basketball.

Referring now to FIG. 6, there is illustrated a perspective view of the gaming board 16 utilized for basketball. The board comprises a flat surface 84, having a printed pattern 86 disposed on the upper surface thereof representing a basketball court. Goals 88 and 90 are disposed at opposite ends of the pattern 86, the goals 88 and 90 represented by the goal of FIG. 3*a*. The pattern 86 has two basketball "keys" at either end thereof and a half-court line 92 disposed in the center thereof. There is a central worded circle in the center of the half-court line 92 and there are three worded circles that are identical images of the other on either side of the half-court line 92.

The object of the game is to accrue the most points when a player has successfully moved all playing tokens to the opposite side of the playing board. Points are collected by landing on designated spaces and successfully completing a goal into the goals 88 or 90, i.e., "thumping" the playing piece 28 into the respective one of the goals 88 or 90. The players start at the central circle at the half-court line 92 and then roll the dice to move from the central circle. If a "1" or a "6" is rolled, the token can be moved from the central circuit into the top of the key on the respective one of the goals 88 and 90 to attempt a "free throw". If a "1" was rolled, the player gets one free shot at the goal and if a "6" was rolled, the player gets two free shots at the goal. If the player is sent back to the central circle on line 92, only a "1" or a "6" showing on the dice will allow them to move. At the beginning of play, the playing tokens are placed inside the large circles, the large circles having six smaller circles disposed therein, and one token is placed in the central circuit at the half-court line 92. Each player has ten tokens. The players move toward opposite ends of the court by rolling the dice. The player first rolls a "1" or a "6" to advance to the top of the key at the respective goals 88 or 90. Once a player is out of the central circle at the half-court line 92, both the dice are rolled and one number is chosen for a large circle. Each large circle is then provided with two numbers and then one number is chosen for the small circle within the larger circle. The worded instructions in the small circle are then followed. However, if all spaces are occupied by a token, the player loses a turn. Play is continued by acting on the wording in the space to determine whether a shot is taken or whether two shots are taken at the appropriate goal with the playing piece 28 until all playing tokens have moved to the opposite sides of the game board's center line. In certain instances, the instructions result in the playing tokens being moved back to the central circle on the half-court line 92. The object is to land on as many of the small circles in the large circles that indicate a "shot" is to be taken at the appropriate one of the goals 88 or 90. The number of points accrued determines the winner of the game.

Figure 7:
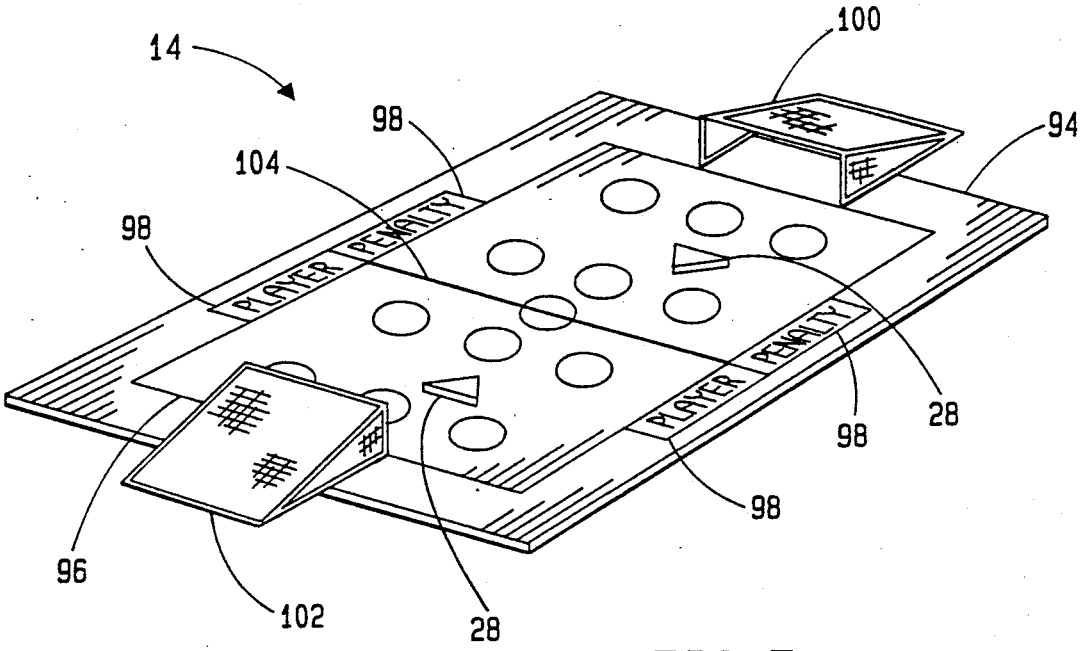
FIG. 7 illustrates the gaming board utilized for hockey.

Referring now to FIG. 7, there is illustrated a perspective view of the gaming board 14 for soccer. The board is configured of a flat surface 94 having a pattern 96 disposed thereon, representing a soccer field. This pattern has disposed on either side thereof penalty and player boxes 98. The goals 100 and 102 are disposed on respective ends of the pattern 96, the goals represented in FIG. 3*c*. The object of the game is to be the first player to collect ten points by successfully completing a goal from a designated shot space. A center line 104 has a start position circle disposed in the center thereof.

Play is begun by providing a player with ten tokens disposed in the respective one of the player's boxes 98. One of these tokens is moved by each player to the start position. In the start position, the player rolls the dice and advances the player token to a numbered space corresponding to the roll. Each of the circles has a number disposed therein designating which one of the circles the playing token is advanced to. The defending player then rolls the dice to determine a goal position. The goal position is a point at which the player disposes their playing piece 28 at the defending goal. A "1" or a "2" represents the left side of the goal. A "3" or a "4" represents the center of the goal. A "5" or a "6" represents the right side of the goal. The playing piece 28 for the defending goal is disposed at the appropriate position on the goal. The player shooting will then propel his playing piece 28 along the surface of the playing board from the appropriate one of the circles. If the shot is complete and goes into the respective one of the goals 100 or 102, this represents one point. If the shot was missed, then the token must be placed in the penalty box. To remove the tokens from this box, the players must return one point for each token they want to remove and place back in the player's box.

Figure 8:
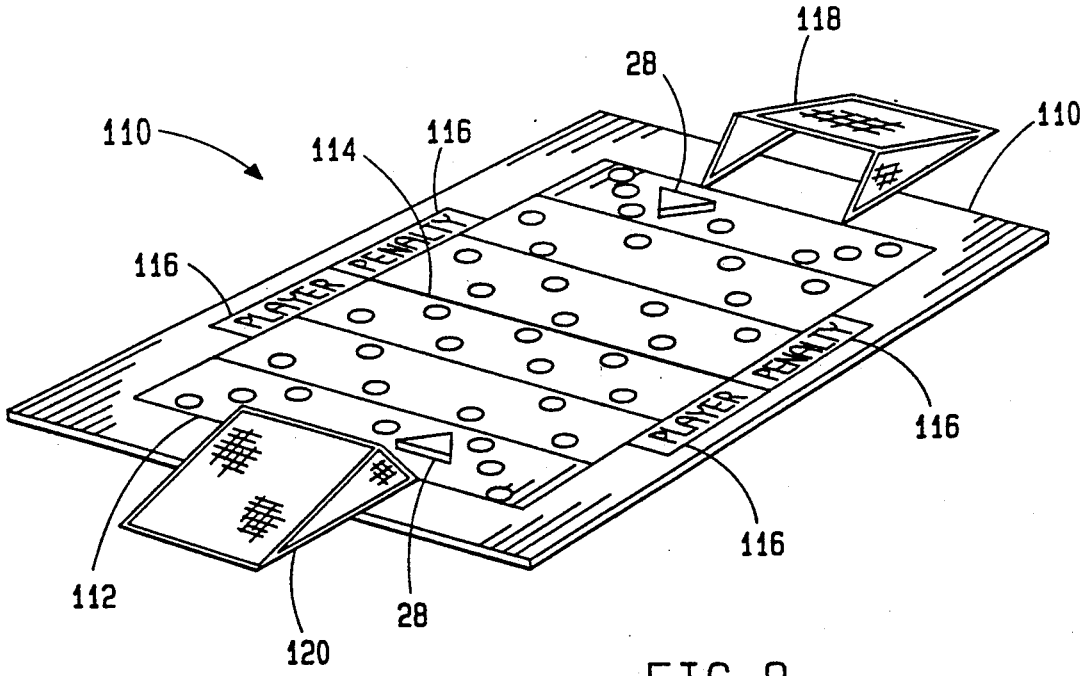
FIG. 8 illustrates the gaming board utilized for soccer.

Referring now to FIG. 8, there is illustrated a perspective view of the gaming board 10 for hockey. The gaming board 10 is comprised of a flat surface 110 having a printed surface 112 thereon. The printed surface 112 has a center line 114 divided into three sections on either side thereof. Each of the three sections has a plurality of worded circles disposed therein. In addition, there are player and penalty boxes 116 disposed on either side thereof for each player. Goals 118 and 120 are disposed on either side of the printed pattern 112, goals 118 and 120 being similar to goals 100 and 102. The object of the game is to advance the playing tokens from one end of the playing field to the opposite end of the field and collecting points by landing on designated goal shot circles and completing a goal. On each side of the center line 114 there are three zones, a first attacking zone proximate to the goal, a second attacking zone midway between the goal and the center line 114 and a neutral zone proximate to the center line 114. Play is begun by placing a token on a circle that is disposed on either side of the center line 114 and central relative thereto. When a player rolls a "1" or a "6", this provides movement from the start position to move to a "free shot" zone which is directly in front of the goal. The opponent then rolls the dice to determine the goalie's position as described above with respect to FIG. 7. A shot is then taken by propelling the game piece 28 across the surface of the board into the respective one of the goals 118 and 120. If missed, play is continued. After the playing token has been advanced from the initial starting point, the tokens are advanced to the opposite end of the field, acting only on the spaces beyond the center line 114. While advancing tokens, only one token at a time can be advanced and only one zone at a time can be advanced to.

In summary, there has been provided a gaming board having a plurality of boards for use with different games. Each of the gaming boards utilizes a flat surface having a printed pattern thereon. Goals provided at either end of a playing piece are utilized to both advance through various numbered spaces and also to allow propelling of the playing piece into a goal or receptacle at either end of the playing board.

Although the preferred embodiment has been described in detail, it should be understood that various changes, substitutions and alterations can be made therein without departing from the spirit and scope of the invention as defined by the appended claims.

What is claimed is:

1. A gaming board system comprising:

a plurality of gaming boards;

a box for containing said gaming boards;

a plurality of playing tokens;

at least one playing piece, said game piece including:

a triangular member having three sides with one side being longer than the other two remaining sides, said playing piece operable to be supported on one corner thereof in an upright position on a supporting surface with the one longer side facing a player and allowing the player to impart a force to a lower end thereto relative to the supported corner to propel the playing piece forward and away from the supporting surface; at least one of the gaming boards including:

a flat surface including said supporting surface, a playing pattern disposed on said flat surface and having goal lines at opposite ends of said pattern to designate a playing area, a goal disposed proximate to each of said goal lines; said goals including uprights disposed above the flat surface of said playing area and disposed apart a pre-determined distance and having a horizontal bar disposed between said uprights at a lower end thereof and above said flat surface, a selectively collapsible net disposed on either end of the playing surface and operable to be disposed in a relaxed and lowered position at or below the flat surface of at least one of said plurality of gaming boards or in an upright position to extend from the flat surface of the at least on of said plurality of gaming boards and substantially above and behind said associated goal, said net further operable to be manipulated by a player and pulled upward behind the respective one of said goals when said playing piece is propelled thereat, and inclined sides disposed along said flat surface at an angle such that they extend upward from the playing surface to contain said playing piece in the playing area.

2. The gaming board system of claim 1, wherein a second one of said gaming boards includes:

a second flat surface;

a second pattern disposed on said second flat surface to provide a gaming area having a predefined game objective associated therewith;

a wall disposed along one side of said second flat surface and said gaming area and having a peripheral edge disposed upward from said second flat surface;

a second pair of uprights disposed along the upper peripheral edge of said wall to provide reference lines and between which said playing piece is to be propelled during the playing of said game;

patterns disposed on said gaming area defining said predefined game objective of said gaming area; and a position mark defined on said second flat surface from which to propel said playing piece upward and between said uprights.

3. The gaming board system of claim 1, wherein said goals on at least one of said gaming boards comprise:

a second upright member;

a hoop-shaped member;

a net disposed about said hoop-shaped member, said hoop-shaped member disposed on an upper end of said second upright member, and operable to receive said playing piece once said playing piece is propelled upward off of the flat surface and toward said hoop-shaped member.

4. The gaming board system of claim 1, wherein said goals of at least one of said gaming boards comprise an opening at one end thereof defined proximate to the flat surface of said gaming boards and extending upward therefrom, said goal having a member resembling a piece of meshed fabric and extending back from said opening to receive said playing piece whenever said playing piece is propelled along the flat surface of said gaming board and directed thereto.

* * * * *

UNITED STATES PATENT AND TRADEMARK OFFICE

CERTIFICATE OF CORRECTION

PATENT NO. : 5,110,127

DATED : May 5, 1992

INVENTOR(S) : James Potter

It is certified that error appears in the above-indentified patent and that said Letters Patent is hereby corrected as shown below:

Claim 1, column 7, line 7, replace "game" with --playing--.

Signed and Sealed this

Eleventh Day of January, 1994

Bruce Lehman

*Attest:*

BRUCE LEHMAN

*Attesting Officer*

*Commissioner of Patents and Trademarks*